US012460641B2

(12) United States Patent
Georgiou

(10) Patent No.: US 12,460,641 B2
(45) Date of Patent: Nov. 4, 2025

(54) ELEMENT, DEVICE AND METHOD FOR COMPRESSING A GAS

(71) Applicant: ATLAS COPCO AIRPOWER, NAAMLOZE VENNOOTSCHAP, Wilrijk (BE)

(72) Inventor: Michail Georgiou, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 0 days.

(21) Appl. No.: 18/580,359

(22) PCT Filed: Jun. 23, 2022

(86) PCT No.: PCT/EP2022/067254

§ 371 (c)(1),
(2) Date: Jan. 18, 2024

(87) PCT Pub. No.: WO2023/001485

PCT Pub. Date: Jan. 26, 2023

(65) Prior Publication Data

US 2024/0344516 A1 Oct. 17, 2024

(30) Foreign Application Priority Data

Jul. 19, 2021 (BE) ..... 2021/5562

(51) Int. Cl.
*F04C 18/16* (2006.01)
*F04C 29/12* (2006.01)

(52) U.S. Cl.
CPC ..... *F04C 18/16* (2013.01); *F04C 29/12* (2013.01)

(58) Field of Classification Search
CPC .. F01C 21/108; F04C 18/16; F04C 2250/102; F04C 29/12; F04C 18/20; F04C 29/00
See application file for complete search history.

(56) References Cited

U.S. PATENT DOCUMENTS

2008/0080997 A1† 4/2008 Chiba
2016/0265529 A1* 9/2016 Branch ..... F01C 21/108
2022/0403845 A1* 12/2022 Tsuchiya ..... F04C 18/20

FOREIGN PATENT DOCUMENTS

CN 108302039 A 7/2018
JP 59-17276 B2 4/1984
WO 2021/084925 A1 5/2021

OTHER PUBLICATIONS

International Search Report for PCT/EP2022/067254, dated Oct. 6, 2022.
Written Opinion for PCT/EP2022/067254, dated Oct. 6, 2022.

* cited by examiner
† cited by third party

*Primary Examiner* — Anthony Ayala Delgado
(74) *Attorney, Agent, or Firm* — Sughrue Mion, PLLC

(57) ABSTRACT

An element for compressing a gas, having a housing (2) in which a first and second rotor (3, 4) are mounted, wherein the housing (2) is provided with an axial outlet opening (8) formed by: a tongue-shaped protrusion (14) between first and second proximal edge (9*b*), wherein an edge of the tongue-shaped protrusion (14) is formed by a first and second tongue edge (13*a*, 13*b*) that is further from the rotational axis of the first or second rotor (3, 4) than the second or first tongue edge (13*a*, 13*b*); and a first tongue edge radius of the first tongue edge (13*a*) relative to the first rotational axis is smaller than a parallel radius of a first geometric path relative to the first rotational axis, which path is a point of contact, situated furthest from the first rotational axis, between the end surfaces of a first and second lobe (5*a*, 5*b*).

16 Claims, 2 Drawing Sheets

PRIOR ART

ELEMENT, DEVICE AND METHOD FOR COMPRESSING A GAS

CROSS REFERENCE TO RELATED APPLICATIONS

This application is a National Stage of International Application No. PCT/EP2022/067254 filed Jun. 23, 2022, claiming priority based on Belgian Patent Application No. BE2021/5562 filed Jul. 19, 2021.

BACKGROUND OF THE INVENTION

Field

The present invention relates to an element, a device and a method for compressing a gas.

Background

Several types of elements for compressing a gas are known from the state of the art.

In a rotary displacement element, the element comprises a housing having an internal space in which one or more rotors with parallel rotational axes are mounted rotatably and adjacent or nearly adjacent to a wall of the internal space, for example two helical rotors which can rotate with their lobes cooperatively in opposite directions of rotation and in contact or nearly in contact with each other.

The housing is provided with an inlet to draw in gas that is to be compressed into the internal space and with an outlet to evacuate compressed gas from the internal space.

The gas drawn in through the inlet is compressed by said helical rotors, by means of a compression chamber between the lobes of the rotors which becomes smaller and smaller as the rotors are turned or rotated.

This rotation also moves the compression chamber from the inlet to the outlet.

This outlet comprises, consists of, or is defined by an outlet opening in the housing.

This outlet opening can be positioned as a so-called axial outlet opening in an end face of the internal space corresponding to an end surface of the helical rotors, and/or designed as a radial port extending from the end face of the internal space around the rotors.

Viewed in a direction parallel to the rotational axes, such an axial outlet opening has a specific shape which is based on a shape that the compression chamber and the helical rotors have in the end surface of the helical rotors.

More specifically, this shape is typically determined by a so-called sealing line, which is a geometric line corresponding to a trajectory of a point of contact between the end surfaces of the rotors during the rotation of the rotors in contact or nearly in contact with each other. Hereby, the sealing line will close off a compression chamber at high pressure, i.e. in a final phase of its compression cycle, from another compression chamber at low pressure and thus separate high-pressure gas from low-pressure gas in the internal space.

The term "point of contact" here does not necessarily mean a direct point of contact, but a point on an outer surface of a rotor where, during rotation, this rotor makes contact or nearly makes contact with the other rotor or, in other words, where this rotor is situated at a minimum distance from the other rotor in an order of magnitude smaller than 1 mm.

Due to the shape based on the sealing line and due to a specific location of the outlet opening in the end face of the internal space, the compression chamber will be connected to the outlet at a correct time so that the compressed gas located in this compression chamber can leave the housing through the outlet opening at a desired pressure, typically slightly higher than an outlet pressure, and without much loss.

In addition, the outlet opening is situated at a location where the lobes of both rotors are rotated in contact or nearly in contact with each other on an outlet side of the screw compressor element, i.e. at a location where the compression chamber is located on the outlet side.

The shape of the outlet opening is determined by its edges, which comprise two so-called proximal edges and two so-called distal edges.

Each proximal edge typically follows a base of the lobes of one of the rotors. Or, in other words, a proximal edge corresponds to a geometric path corresponding to a part of a trajectory which the base of the lobes during rotation of the rotor in question describes.

The base of the lobes is a portion of the rotor with a minimum extreme radius.

Each distal edge typically follows a partial trajectory of a tip of an end surface of a lobe of one of the rotors when the end surface of this lobe rotates toward, but not yet in contact or nearly in contact with, the other rotor.

Between the two proximal edges a tongue-shaped protrusion or so-called tongue is formed whose shape is determined by said sealing line.

The term "tongue-shaped" is used here to mean that the protrusion, viewed in a direction parallel to the rotational axes, has an elongated shape formed by two axially lateral tongue edges that start from a foot or base and eventually converge into a possibly truncated tip, or in other words a shape typically like that of a transverse section of an intact free end of a human tongue.

More specifically, viewed in a direction parallel to the rotational axes, the tip of the tongue-shaped protrusion is formed by a point of contact where the end surfaces of the lobes of the rotors first contact or nearly contact each other, and each of two tongue edges of the tongue-shaped protrusion which extend from the tip is formed by a part of a trajectory of one of two different points of contact between the end surfaces of the lobes. Hereby, the tongue-shaped protrusion extends in a direction opposite to a direction in which the rotors rotate right between their rotational axes.

This tongue-shaped protrusion is a restrictive portion for the outlet opening, which portion is situated where the end surfaces of the lobes of both rotors are rotated in contact or nearly in contact with each other, and prevents backflow of compressed gas through the outlet opening to an inlet side of the internal space, which would otherwise occur between the two different points of contact.

The known shape of the outlet opening, however, has a number of disadvantages.

One disadvantage is that during a final stage in which the compression chamber is in fluid contact with the outlet opening, a so-called dynamic overcompression of the gas in the compression chamber takes place. This is due to the fact that an area of the compression chamber that is at that time in fluid contact with the outlet port is not sufficient to obtain a proper and smooth evacuation of the compressed gas from the compression chamber to the outlet.

This is coupled with locally very high pressures in the compression chamber, for which the element is not designed and which can lead to damage to the element.

Another disadvantage is that there is always a portion of the compressed gas in the compression chamber that cannot leave the internal space through the outlet opening. This is because, through further rotation of the rotors, each of the points of contact, viewed in the direction parallel to the rotational axes, advances over an edge of the tongue from the tip of the tongue to a foot of the tongue; and after the points of contact have reached the foot of the tongue, the compression chamber is no longer in fluid connection with the outlet opening.

This aforementioned portion of the compressed gas will leak away toward the inlet side of the internal chamber when the rotors are rotated further, and thus entails an efficiency loss.

The present invention has the objective of providing a solution for at least one of the aforementioned and/or other disadvantages.

SUMMARY OF THE INVENTION

The subject-matter of the present invention is an element for compressing a gas, wherein the element comprises a housing enclosing an internal space in which a helical first rotor and a helical second rotor are mounted rotatably and adjacent or nearly adjacent to a wall of the internal space, such that, during a rotation cycle of the first rotor and the second rotor in opposite directions of rotation, a first lobe of the first rotor and a second lobe of the second rotor rotate in contact or nearly in contact with each other at a location between the first rotor and the second rotor wherein the housing is provided with an inlet for guiding gas to be compressed toward and into the internal space and an outlet for guiding compressed gas out of and away from the internal space, wherein the outlet comprises an axial outlet opening abutting the internal space, wherein, viewed in a direction parallel to a first rotational axis of the first rotor and a second rotational axis of the second rotor, the outlet opening is formed by:

a first distal edge situated entirely within a first angle of rotation around the first rotational axis in which an end surface of the first lobe facing the outlet opening rotates during the rotation cycle toward or within a maximum turning circle of an end surface of the second lobe facing the outlet opening;

a second distal edge situated entirely within a second angle of rotation around the second rotational axis in which said end surface of the second lobe rotates during the rotation cycle toward or within a maximum turning circle of said end surface of the first lobe;

a first proximal edge situated entirely within the first angle of rotation at a smaller distance from the first rotational axis than the first distal edge;

a second proximal edge situated entirely within the second angle of rotation at a smaller distance from the second rotational axis than the second distal edge;

a tongue-shaped protrusion between the first proximal edge and the second proximal edge, which protrusion is positioned within, firstly, a third angle of rotation around the first rotational axis in which said end surface of the first lobe and said end surface of the second lobe rotate in contact or nearly in contact with each other during the rotation cycle and, secondly, a fourth angle of rotation around the second rotational axis in which said end surface of the first lobe and said end surface of the second lobe rotate in contact or nearly in contact with each other during the rotation cycle, wherein the tongue-shaped protrusion is fastened to a base piece of the housing and extends from the base piece in a direction opposite to a direction in which the first rotor and the second rotor rotate right between the first rotational axis and the second rotational axis during the rotation cycle, and wherein an edge of the tongue-shaped protrusion is formed by at least a first tongue edge and a second tongue edge which extend from the base piece, wherein the first tongue edge is further from the rotational axis of the first rotor than the second tongue edge and the second tongue edge is further from the rotational axis of the second rotor than the first tongue edge;

with the characteristic that a first tongue edge radius of the first tongue edge relative to the first rotational axis over an entire length of the first tongue edge is smaller than a radius, parallel to the first tongue edge radius, of a first geometric path relative to the first rotational axis, which first geometric path is described by a point of contact, situated furthest from the first rotational axis, between said end surface of the first lobe and said end surface of the second lobe during the rotation cycle.

An 'edge' of the tongue-shaped protrusion means that part of a circumference of the tongue-shaped protrusion which partially forms the outlet opening.

'Tongue edge radius' in this context means a straight distance between a point of a tongue edge on the one hand and a rotational axis on the other hand, which straight distance may be variable over the length of the tongue edge.

Preferably, the first tongue edge radius is at least 2.5% smaller than said radius of the first geometric path over an entire length of the first tongue edge.

By making the first tongue edge radius of the first tongue edge smaller than the radius of the first geometric path, the outlet opening will effectively become larger than in already known elements where the first tongue edge, viewed in the direction parallel to the first and second rotational axes, coincides with the first geometric path.

It is important to note that such a change in the shape of the outlet opening at the location of the first tongue edge is counterintuitive, as this change results in the outlet opening being in fluid connection with low-pressure zones on an inlet side of the internal space at certain times during rotation of the screw rotors, which is known to result in leakage of compressed gas to the inlet side.

This change in the shape of the outlet opening will intentionally create these leaks in order to discharge a required part of the compressed gas to reduce overcompression in the compression chamber.

One advantage, therefore, is that this shape of the outlet opening will greatly reduce the aforementioned overcompression.

It should be noted that, viewed in the direction parallel to the first and second rotational axes, the overcompression of the gas in the compression chamber and the leakage of compressed gas to the inlet side both occur at the first tongue edge and consequently close to each other.

In addition, the shape of the outlet opening will also allow more of the compressed gas in the compression chamber to leave the internal space and ultimately the element through the outlet opening in comparison to known elements.

In the element, this results in a reduction in relative power consumption (Specific Energy Requirement, SER) or power requirement per quantity of compressed gas produced.

Consequently, the element has a higher efficiency than known elements.

In a preferred embodiment of the element according to the invention, a second tongue edge radius of the second tongue edge relative to the second rotational axis over an entire length of the second tongue edge is smaller than a radius, parallel to the second tongue edge radius, of a second geometric path relative to the second rotational axis, which second geometric path is described by a point of contact, situated furthest from the second rotational axis, between said end surface of the first lobe and said end surface of the second lobe during the rotation cycle.

Preferably, the second tongue edge radius is at least 2.5% smaller than said radius of the second geometric path over an entire length of the second tongue edge.

By also making the second tongue edge radius of the second tongue edge smaller than the radius of the second geometric path, the outlet opening will effectively become larger than in already known elements where the second tongue edge, viewed in the direction parallel to the first and second rotational axes, coincides with the second geometric path.

The advantages of this are obviously similar to those described above which are obtained by making the first tongue edge radius smaller in comparison to known elements.

In another preferred embodiment of the element according to the invention, the first rotor is a male screw rotor and the second rotor is a female screw rotor.

Indeed, in the case where a male and a female screw rotor are mounted in the internal space of the element, the compression chamber, in a final phase in which the compression chamber is in fluid contact with the outlet opening and in which gas in the compression chamber is overcompressed, touches a base of the female rotor.

Consequently, the advantages of a percentage reduction in a tongue edge radius of a tongue edge closest to the female rotor will be relatively greater than the advantages of an equally large percentage reduction in a tongue edge radius of a tongue edge closest to the male rotor.

In the case where, for example, only the first tongue edge radius is smaller than the radius of the first geometric path and the second tongue edge radius is not smaller than the radius of the second geometric path, it will consequently be more advantageous if the first rotor is a male rotor and the second rotor is a female rotor than if the first rotor were a female rotor and the second rotor were a male rotor.

In another preferred embodiment of the element according to the invention, viewed in the direction parallel to the first rotational axis and the second rotational axis, the outlet opening is further formed by a connecting edge of the tongue-shaped protrusion, which connecting edge connects the first tongue edge with the second tongue edge such that the tongue-shaped protrusion has a truncated shape at the connecting edge.

Due to the connecting edge between the first and second tongue edges and the associated truncated shape of the tongue-shaped protrusion, the outlet opening will increase in area.

This will have the effect of further reducing the overcompression in the compression chamber and further reducing the relative power consumption.

In another preferred embodiment of the element according to the invention, the element is a screw compressor element, preferably an oil-free screw compressor element.

However, the scope of the invention does not preclude the screw compressor element from being a fluid-injected screw compressor element, an oil-free screw vacuum pump element, a fluid-injected screw vacuum pump element, an oil-free screw blower element or a fluid-injected screw blower element.

In another preferred embodiment of the element according to the invention, viewed in the direction parallel to the first rotational axis and the second rotational axis, a distance from at least a part of the first distal edge to the first rotational axis is smaller than a radius of the maximum turning circle of said end surface of the first lobe.

In another preferred embodiment of the element according to the invention, viewed in the direction parallel to the first rotational axis and the second rotational axis, a distance from at least a part of the second distal edge to the second rotational axis is smaller than a radius of the maximum turning circle of said end surface of the second lobe.

By making the distance between, on the one hand, the first distal edge and/or the second distal edge and, on the other hand, the first rotational axis or the second rotational axis, respectively, smaller than the radius of the maximum turning circle of the end surface of the first lobe or the second lobe, respectively, an area in which the compression chamber is in fluid contact with the outlet opening during the rotation cycle can be reduced as desired at a location where said end surface of the first lobe and said end surface of the second lobe are not yet in contact or nearly in contact with each other during the rotation cycle and there is not yet any overcompression in the compression chamber.

In this way, a pressure ratio across the element, i.e. a ratio of a pressure at the outlet to a pressure at the inlet, is increased.

In another preferred embodiment of the element according to the invention, viewed in the direction parallel to the first rotational axis and the second rotational axis, in the third angle of rotation, a radius of the first proximal edge relative to the first rotational axis is equal to or smaller than a radius of a base of the first lobe relative to the first rotational axis.

In another preferred embodiment of the element according to the invention, viewed in the direction parallel to the first rotational axis and the second rotational axis, in the fourth angle of rotation, a radius of the second proximal edge relative to the second rotational axis equal to or smaller than a radius of a base of the second lobe relative to the second rotational axis.

By taking the radius of the first and/or second proximal edge to be equal to or smaller than the radius of the base of the first lobe or the second lobe, respectively, in the third angle of rotation or the fourth angle of rotation, respectively, an area of the compression chamber that is in fluid contact with the outlet port within this third angle of rotation or fourth angle of rotation, respectively, will be kept as maximal as possible.

It is precisely within this third angle of rotation and fourth angle of rotation that the problem of overcompression in the compression chamber occurs to a significant extent in known elements for compressing gas.

Keeping the area of the compression chamber that is in fluid contact with the outlet port within this third angle of rotation or fourth angle of rotation, respectively, as maximal as possible will minimize this problem of overcompression in the compression chamber.

In another preferred embodiment of the element according to the invention, viewed in the direction parallel to the first rotational axis and the second rotational axis, outside the third angle of rotation, a distance from at least a part the first proximal edge to the first rotational axis is greater than a radius of a base of the first lobe.

In another preferred embodiment of the element according to the invention, viewed in the direction parallel to the first rotational axis and the second rotational axis, outside the fourth angle of rotation, a distance from at least a part of the second proximal edge to the second rotational axis is greater than a radius of a base of the second lobe.

By making the distance between, on the one hand, the first proximal edge and/or the second proximal edge and, on the other hand, the first rotational axis or the second rotational axis, respectively, greater than the radius of the base of the first rotor or the second rotor, respectively, outside the third angle of rotation or the fourth angle of rotation, respectively, an area in which the compression chamber is in fluid contact with the outlet opening during the rotation cycle can be reduced as desired at a location where the first lobe and the second lobe are not yet in contact or nearly in contact with each other during the rotation cycle and there is not yet any overcompression in the compression chamber.

In this way, a pressure ratio across the element, i.e. a ratio of a pressure at the outlet to a pressure at the inlet, is increased.

The invention also relates to a device for compressing a gas, which device comprises an element according to the invention.

It goes without saying that the advantages associated with such a device are the same as those of the element in question.

The invention also relates to a method for evacuating compressed gas from an element according to the invention, wherein the method comprises the step of evacuating the compressed gas from the internal space through the outlet opening, with the characteristic that no point of contact between said end surface of the first lobe and said end surface of the second lobe, viewed in the direction parallel to the first rotational axis and the second rotational axis, overlaps with the tongue-shaped protrusion at any time during the rotation cycle.

It is at and between a first and second point of contact of the first rotor and the second rotor that leaks of compressed gas to the inlet side of the internal space can occur, with the advantages thereof as described above.

BRIEF DESCRIPTION OF THE INVENTION

With a view to better illustrating the features of the invention, some preferred embodiments of an element for compressing a gas according to the invention, a device equipped therewith and a method according to the invention for compressing a gas are described below as examples without any limiting character with reference to the attached drawings, in which:

FIG. 1 schematically shows an element for compressing a gas according to the invention;

DETAILED DESCRIPTION OF THE INVENTION

Figure 1:
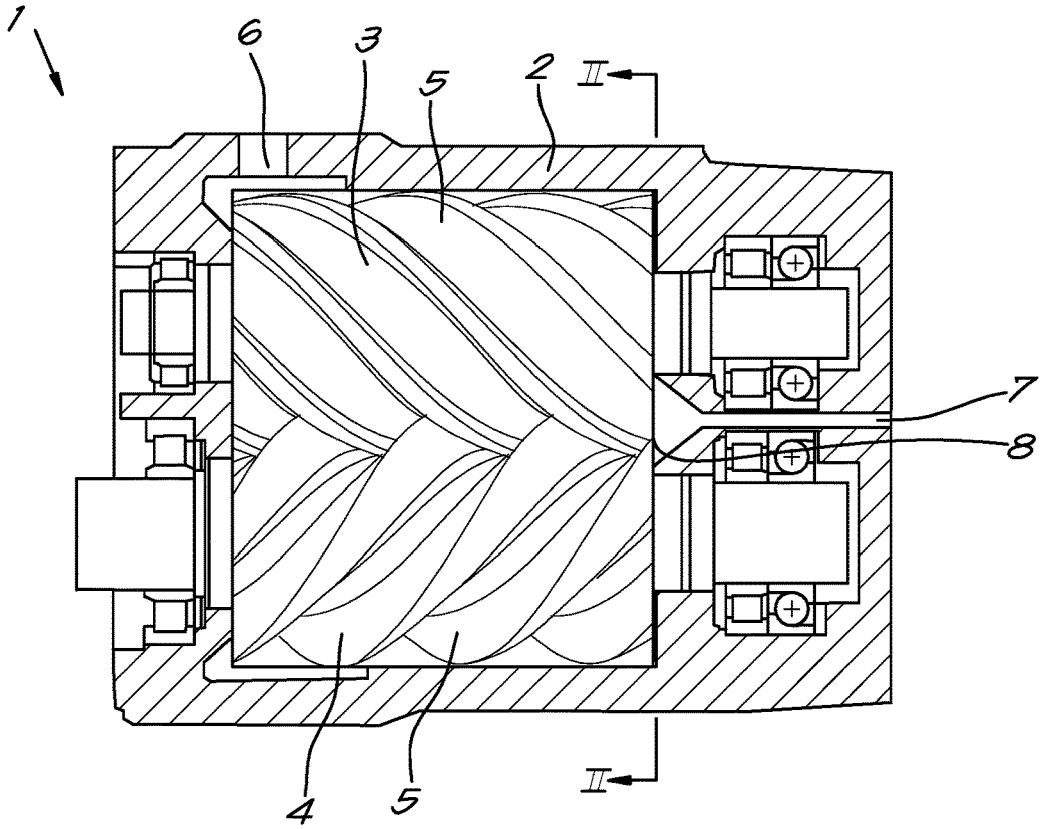

FIG. 1 schematically shows an element for compressing a gas according to the invention, in this case a screw compressor element 1.

It comprises a housing 2 enclosing an internal space in which two helical rotors 3, 4 having lobes 5 are mounted rotatably and adjacent or nearly adjacent to a wall of the internal space, namely a male first rotor 3 and a female second rotor 4, which can rotate into each other cooperatively.

The screw compressor element 1 is in this case, but not necessary for the invention, an oil-free screw compressor element 1, which means that no oil is injected into the housing 2 to lubricate, cool and/or seal the rotors 3, 4.

Alternatively, the screw compressor element 1 can also be an oil-injected screw compressor element, a water-injected screw compressor element, an oil-free screw vacuum pump element, an oil-injected screw vacuum pump element, a water-injected screw vacuum pump element, an oil-free screw blower element, an oil-injected screw blower element or a water-injected screw blower element.

The housing 2 is provided with an inlet 6 for guiding gas to be compressed toward and into the internal space and an outlet 7 for guiding compressed gas out of and away from the internal space. The outlet 7 comprises an axial outlet opening 8 abutting the internal space in the housing 2, i.e. a physical opening in the housing 2.

The scope of the invention does not preclude the outlet from also comprising a radial port extending around the rotors from an end face of the internal space that contains the outlet opening 8.

Figure 2:
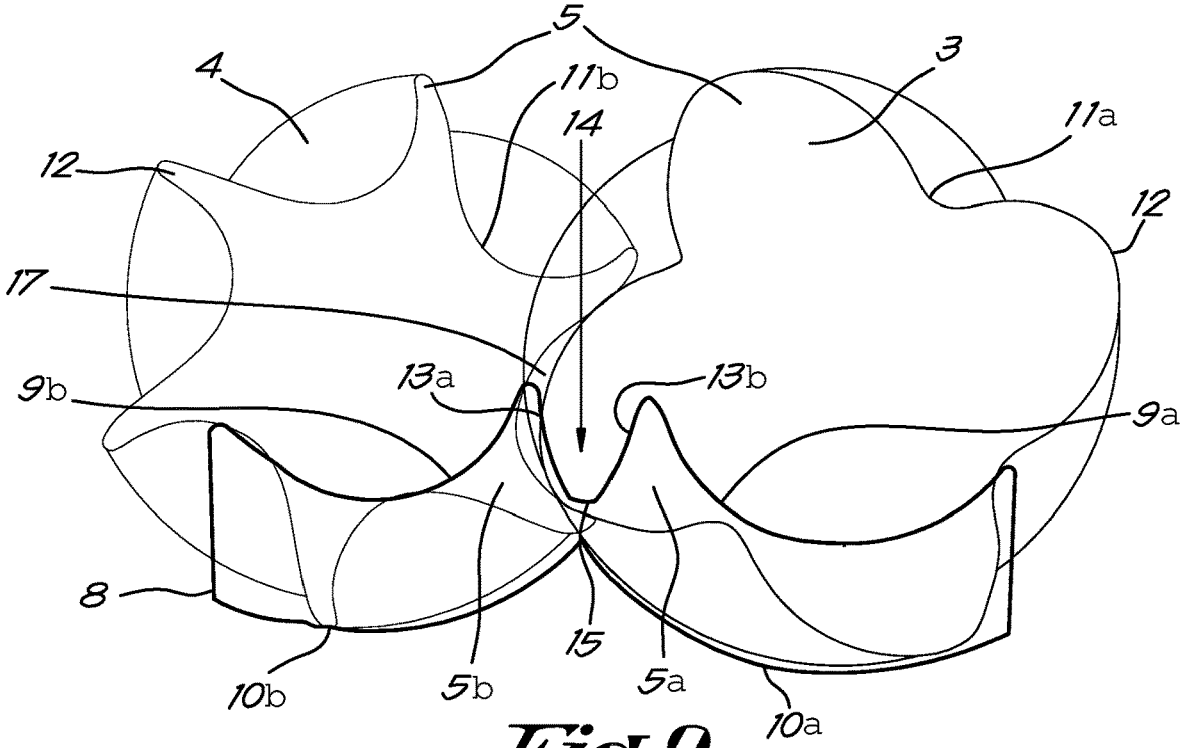
FIG. 2 shows a cross-section along line II-II in FIG. 1, with the axial outlet opening of the element of FIG. 1 visible.
Figure 3:
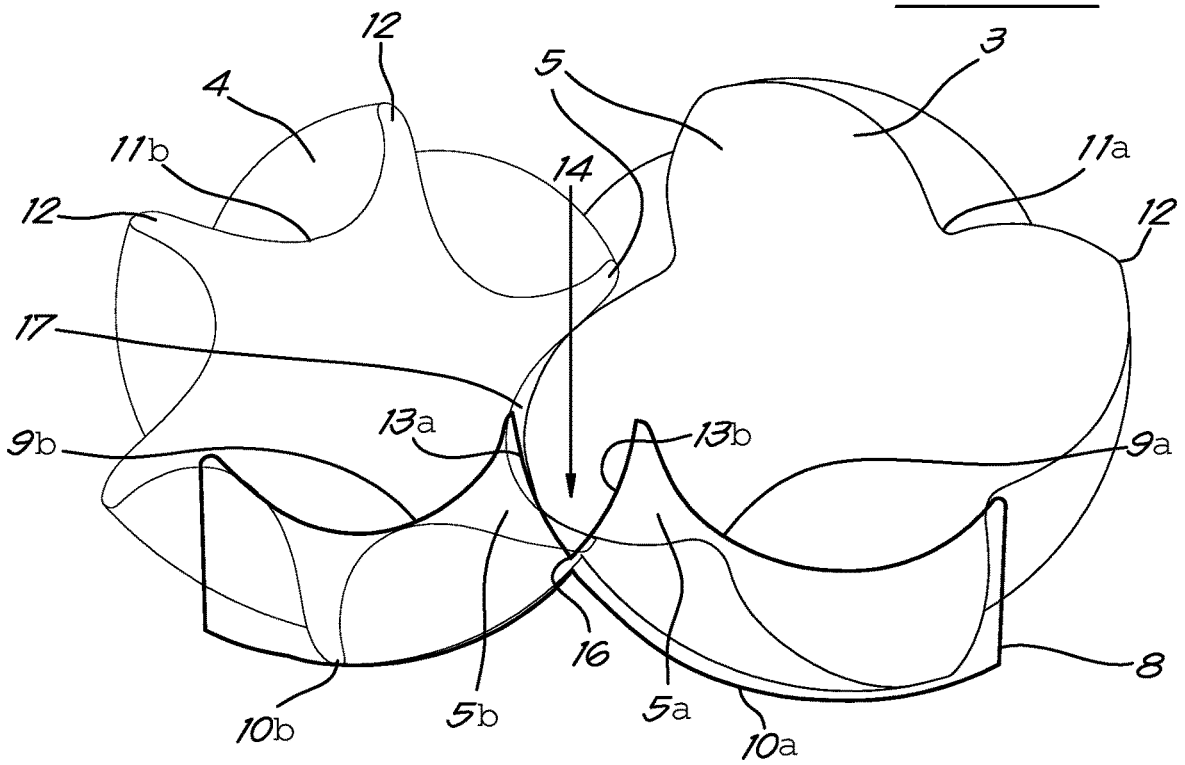
FIG. 3 shows the same view as FIG. 2, but of a known element with a known axial outlet opening.

FIGS. 2 and 3 schematically show, respectively, the outlet opening 8 according to the invention and the outlet opening 8 of an already known element, viewed in a direction parallel to a rotational axis of the first rotor 3 and a second rotational axis of the second rotor 4, with the housing 2 not being shown for clarity reasons.

This outlet opening 8 comprises a number of edges 9*a*, 9*b*, 10*a*, 10*b*, 13*a*, 13*b*.

First, the outlet opening comprises two proximal edges 9*a*, 9*b*. In the outlet opening 8 of a known element as shown in FIG. 3, viewed in the direction parallel to the first rotational axis and the second rotational axis, a first proximal edge 9*a* coincides entirely with a part of a trajectory which a base 11*a* of the lobes 5 of the first rotor 3 describes. A second proximal edge 9*b* in FIG. 3, viewed in the direction parallel to the first rotational axis and the second rotational axis, coincides entirely with a part of a trajectory which a base 11*b* of the lobes 5 of the second rotor 4 describes.

In the outlet opening 8 of an element according to the present invention as shown in FIG. 2, a radius of the first proximal edge 9*a* relative to the first rotational axis or the second proximal edge 9*b* relative to the second rotational axis, viewed in the direction parallel to the first rotational axis and the second rotational axis, can be as large as a radius of a geometric path of the base 11*a* of the first rotor 3 or the base 11*b* of the second rotor 4, respectively. However, the invention does not preclude the radius of the first proximal edge 9*a*, viewed in the direction parallel to the first rotational axis and the second rotational axis, outside a third angle of rotation around the first rotational axis where a first lobe 5*a* of the first rotor 3 and a second lobe 5*b* of the second rotor 4 rotate in contact or nearly in contact with each other, from being greater than the radius of the geometric path of the base 11*a*. The invention also does not preclude the radius of the second proximal edge 9*b*, viewed in the direction parallel to the first rotational axis and the second rotational axis, outside a fourth angle of rotation around the second rotational axis where the first lobe 5*a* of the first rotor 3 and the second lobe 5*b* of the second rotor 4 rotate in contact or nearly in contact with each other, from being greater than the radius of the geometric path of the base 11*b*.

Furthermore, the outlet opening 8 comprises two distal edges 10*a*, 10*b*.

The distal edges 10*a*, 10*b* are, for the outlet opening 8 of an already known element as shown in FIG. 3, those edges of the outlet opening 8 which, viewed in the direction parallel to the first rotational axis and the second rotational axis, coincide entirely with a part of a trajectory of the tips 12 of the lobes 5 of the rotors 3, 4.

As for the known outlet opening 8 in FIG. 3, a first distal edge 10*a* coincides entirely with a part of a trajectory of the tips 12 of the lobes 5 of the first rotor 3 within a first angle of rotation around the first rotational axis wherein, viewed in the direction parallel to the first rotational axis and the second rotational axis, the tips 12 of the lobes 5 of the first rotor 3 rotate during the rotation cycle toward or just within a maximum turning circle of the lobes 5 of the second rotor 4. A second distal edge 10*b* coincides entirely with a part of a trajectory of the tips 12 of the lobes 5 of the second rotor 4 within a second angle of rotation around the second rotational axis wherein, viewed in the direction parallel to the first rotational axis and the second rotational axis, the tips 12 of the lobes 5 of the second rotor 4 rotate during the rotation cycle toward or just within a maximum turning circle of the lobes 5 of the first rotor 3.

In the outlet opening 8 of an element according to the present invention as shown in FIG. 2, a radius of the first distal edge 10*a* relative to the first rotational axis or the second distal edge 10*b* relative to the second rotational axis, viewed in the direction parallel to the first rotational axis and the second rotational axis, can be as large as a radius of a geometric path of the tips 12 of the lobes 5 of the first rotor 3 or the second rotor 4, respectively. However, the invention does not preclude the radius of the first distal edge 10*a* and/or the second distal edge 10*b*, viewed in the direction parallel to the first rotational axis and the second rotational axis, from being smaller than the radius of the geometric path of the tips 12 of the lobes 5 of the first rotor 3 or the second rotor 4, respectively.

A piece of the housing 2 between the two proximal edges 9*a*, 9*b* within the third angle of rotation and the fourth angle of rotation is a restrictive portion referred to as a tongue-shaped protrusion 14 or the tongue.

A shape of this tongue-shaped protrusion 14 is determined in the known outlet opening 8 in FIG. 3 according to a sealing line between the first rotor 3 and the second rotor 4. More specifically, two tongue edges 13*a*, 13*b* of the tongue-shaped protrusion 14, viewed in the direction parallel to the first rotational axis and the second rotational axis, both follow a geometric path of a different point of contact between end surfaces of the lobes 5 of the first rotor 3 and the rotor 4, said end surfaces facing the outlet opening 8, during the rotation cycle.

The tongue-shaped protrusion 14 is fastened as part of the housing 2 to a base piece of the housing 2 and extends from this base piece in a direction opposite to a direction in which the first rotor 3 and the second rotor 4 rotate right between the first rotational axis and the second rotational axis during the rotation cycle.

A first tongue edge 13*a* is further from the rotational axis of the first rotor 3 than the second tongue edge 13*b* and the second tongue edge 13*b* is further from the rotational axis of the second rotor 4 than the first tongue edge 13*a*.

According to an embodiment of the invention as shown in FIG. 2, a first tongue edge radius of the first tongue edge 13*a* relative to the first rotational axis over an entire length of the first tongue edge 13*a*, viewed in the direction parallel to the first rotational axis and the second rotational axis, is smaller than a radius, parallel to this first tongue edge radius, of a first geometric path described by a point of contact, farthest from the first rotational axis, between the end surfaces of the lobes 5 of the first rotor 3 and the second rotor 4 during the rotation cycle.

As a result, said tongue-shaped protrusion 14, viewed in the direction parallel to the first rotational axis and the second rotational axis, is smaller in area in the outlet opening 8 according to the invention in FIG. 2 than in the already known outlet opening 8 in FIG. 3. Note that such adjustment is counter-intuitive, since such an adjustment means intentional leakage of compressed gas from the outlet 7 to an inlet side of the element.

In other words, the outlet opening 8 according to the invention in FIG. 2 is larger, i.e. has a larger area, than the known outlet opening 8 in FIG. 3. It is, as already mentioned, more particularly said tongue-shaped protrusion 14 which is smaller in the outlet opening 8 according to the invention than in the outlet opening 8 according to the known element in FIG. 3.

Preferably, the first tongue edge radius is at least 2.5% smaller than said radius of the first geometric path over an entire length of the first tongue edge 13*a*.

It is possible for the radius to be more than 2.5% smaller.

In the scope of the invention, a first edge of the base piece of the housing 2 to which the tongue-shaped protrusion 14 is fastened, viewed in the direction parallel to the first rotational axis and the second rotational axis, is not precluded from still overlapping at least partially with the first geometrical path.

In the case of the outlet opening 8 according to the invention in FIG. 2, the second tongue edge radius of a second tongue edge 13*b*, relative to the second rotational axis over an entire length of the second tongue edge 13*b*, viewed in the direction parallel to the first rotational axis and the second rotational axis, is also smaller than a radius, parallel to this second tongue edge radius, of a second geometric path described by a point of contact, farthest from the second rotational axis, between the end surfaces of the lobes 5 of the first rotor 3 and the second rotor 4 during the rotation cycle.

In the scope of the invention, a second edge of the base piece of the housing 2 to which the tongue-shaped protrusion 14 is fastened, viewed in the direction parallel to the first rotational axis and the second rotational axis, is not precluded from still overlapping at least partially with the second geometrical path.

In this case, in order to further reduce the area of the tongue-shaped protrusion 14 in the element according to the invention in FIG. 2 in comparison with an already known element as shown in FIG. 3, the outlet opening 8 in FIG. 2 is furthermore also formed by a connecting edge 15 of the tongue-shaped protrusion 14, which connecting edge 15 connects the first tongue edge 13*a* with the second tongue edge 13*b*, thereby cutting off a tip 16 of the tongue-shaped protrusion 14 in the already known element in FIG. 3, such that the tongue-shaped protrusion 14 according to the invention in FIG. 2 has a truncated shape.

As can be seen in FIG. 2, the edges of the outlet opening 8 are rounded. This is to facilitate the manufacture of the housing 2 by casting.

Figure 4:
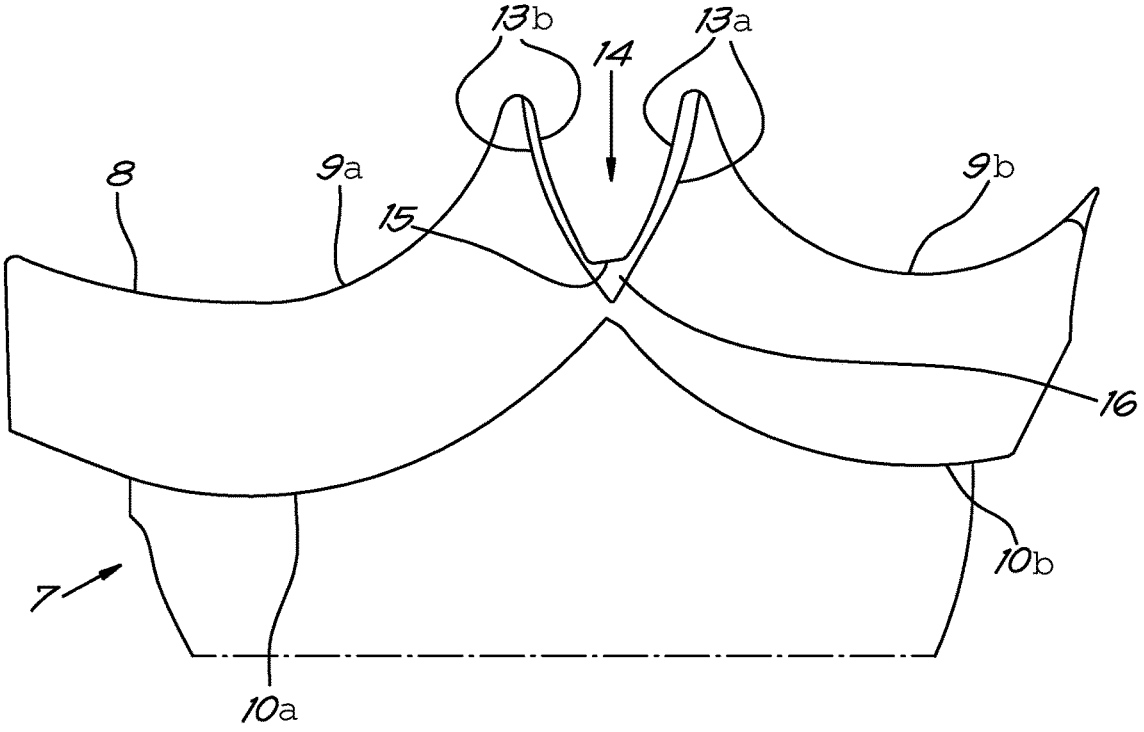
FIG. 4 shows a superimposition and horizontal mirroring of the axial outlet opening of FIG. 2 on the known axial outlet opening of FIG. 3.

In FIG. 4, the outlet openings 8 of FIGS. 2 and 3 are shown superimposed on each other and mirrored horizontally, thus visually illustrating where the outlet opening 8 is made larger.

It can be clearly seen in FIG. 4 that said tongue-shaped protrusion 14 is smaller in an outlet opening 8 according to the invention, and that the tip 16 is cut off.

An operation of the screw compressor element 1 is very simple and as follows.

During the operation, the screw rotors 3, 4 together with their lobes 5 will rotate in contact or nearly in contact with each other.

Gas to be compressed, for example ambient air, is drawn in through the inlet 6.

The gas drawn in to be compressed enters a so-called compression chamber 17 between the lobes 5 of the screw rotors 3, 4.

The rotation of the screw rotors 3, 4 causes the compression chamber 17 to move toward the outlet 7 and at the same time become smaller so that gas is compressed in this chamber.

When the compression chamber 17 on the outlet side of the internal space finally overlaps with the outlet opening 8, viewed in the direction parallel to the first rotational axis and the second rotational axis, a fluid connection will be made between the compression chamber 17 and the outlet 7 so that the now compressed gas from the compression chamber 17 will leave the screw compressor element 1.

FIGS. 2 and 3 indicate the compression chamber 17.

The shape of the outlet opening 8 is determined by the aforementioned sealing line and is chosen such that the moment of fluid connection between the compression chamber 17 and the outlet 7 occurs during the final phase of compression and also ensures that the fluid connection is broken at the moment when the compression chamber 17 in question comes back into fluid connection with the inlet 6. Hereby, the sealing line forms a separation between gas at high pressure on the one hand and gas at low pressure on the other hand in the internal space.

A comparison of FIGS. 2 and 3 clearly shows that the compression chamber 17 in FIG. 2 will be in fluid connection with the outlet opening 8 for longer than the compression chamber 17 in FIG. 3. In comparison to known screw compressor elements, there will also be intentional leaks from the outlet 7 to the inlet side of the internal space.

As a result, virtually all of the compressed gas will have the opportunity to escape from the compression chamber 17 of FIG. 2. The quantity of compressed gas that can leak directly away from the compression chamber 17 to the inlet side of the internal space will be smaller in the case of FIG. 2 compared to the situation of FIG. 3.

There will also be less overcompression in the compression chamber 17, that is, a maximum pressure in the compression chamber 17 of FIG. 2 just after the compression chamber 17 is closed off from the outlet opening 8 will be lower than for the situation in FIG. 3.

As already mentioned, this has the effect of increasing the efficiency of the screw compressor element 1 because the relative power consumption (Specific Energy Requirement, SER), or the power per quantity of compressed gas produced, is reduced.

The magnitude of a percentage reduction in relative power consumption depends on the speed of the compressor element and is typically lower at high speeds and higher at the lowest speeds of the screw compressor element.

The present invention is by no means limited to the embodiments described as examples and shown in the figures, but an element for compressing a gas according to the invention, a device equipped therewith and a method according to the invention for compressing a gas can be realized in a variety of shapes and sizes without departing from the scope of the invention as defined in the claims.

The invention claimed is:

1. An element for compressing a gas, wherein the element comprises a housing enclosing an internal space in which a helical first rotor and a helical second rotor are mounted rotatably and adjacent to a wall of the internal space, such that, during a rotation cycle of the first rotor and the second rotor in opposite directions of rotation, a first lobe of the first rotor and a second lobe of the second rotor rotate in contact with each other at a location between the first rotor and the second rotor, wherein the housing is provided with an inlet for guiding gas to be compressed toward and into the internal space and an outlet for guiding compressed gas out of and away from the internal space, wherein the outlet comprises an axial outlet opening abutting the internal space, wherein, viewed in a direction parallel to a first rotational axis of the first rotor and a second rotational axis of the second rotor, the outlet opening is formed by:

a first distal edge situated entirely within a first angle of rotation around the first rotational axis in which an end surface of the first lobe facing the outlet opening rotates during the rotation cycle toward or within a maximum turning circle of an end surface of the second lobe facing the outlet opening;

a second distal edge situated entirely within a second angle of rotation around the second rotational axis in which said end surface of the second lobe rotates during the rotation cycle toward or within a maximum turning circle of said end surface of the first lobe;

a first proximal edge situated entirely within the first angle of rotation at a smaller distance from the first rotational axis than the first distal edge;

a second proximal edge situated entirely within the second angle of rotation at a smaller distance from the second rotational axis than the second distal edge;

a tongue-shaped protrusion between the first proximal edge and the second proximal edge, which protrusion is positioned within, firstly, a third angle of rotation around the first rotational axis in which said end surface of the first lobe and said end surface of the second lobe rotate in contact with each other during the rotation cycle and, secondly, a fourth angle of rotation around the second rotational axis in which said end surface of the first lobe and said end surface of the second lobe rotate in contact with each other during the rotation cycle, wherein the tongue-shaped protrusion is fastened to a base piece of the housing and extends from the base piece in a direction opposite to a direction in which the first rotor and the second rotor rotate right between the first rotational axis and the second rotational axis during the rotation cycle, wherein an edge of the tongue-shaped protrusion is formed by at least a first tongue edge and a second tongue edge which extend from the base piece, wherein the first tongue edge is further from the rotational axis of the first rotor than the second tongue edge and the second tongue edge is further from the rotational axis of the second rotor than the first tongue edge; and wherein a first tongue edge radius of the first tongue edge relative to the first rotational axis over an entire length of the first tongue edge is smaller than a radius, parallel to the first tongue edge radius, of a first geometric path relative to the first rotational axis, which first geometric path is described by a point of contact, situated furthest from the first rotational axis, between said end surface of the first lobe and said end surface of the second lobe during the rotation cycle.

2. The element according to claim 1, wherein the first tongue edge radius, over an entire length of the first tongue edge, is at least 2.5% smaller than said radius of the first geometric path.

3. The element according to claim 1, wherein a second tongue edge radius of the second tongue edge relative to the second rotational axis over an entire length of the second tongue edge is smaller than a radius, parallel to the second tongue edge radius, of a second geometric path relative to the second rotational axis, which second geometric path is described by a point of contact, situated furthest from the second rotational axis, between said end surface of the first lobe and said end surface of the second lobe during the rotation cycle.

4. The element according to claim 3, wherein the second tongue edge radius, over an entire length of the second tongue edge, is at least 2.5% smaller than said radius of the second geometric path.

5. The element according to claim 1, wherein the first rotor is a male screw rotor and the second rotor is a female screw rotor.

6. The element according to claim 1, wherein, viewed in the direction parallel to the first rotational axis and the second rotational axis, the outlet opening is further formed by a connecting edge of the tongue-shaped protrusion, which connecting edge connects the first tongue edge with the second tongue edge such that the tongue-shaped protrusion has a truncated shape at the connecting edge.

7. The element according to claim 1, wherein the element is a screw compressor element.

8. The element according to claim 7, wherein the element is an oil-free screw compressor element.

9. The element according to claim 1, wherein, viewed in the direction parallel to the first rotational axis and the second rotational axis, a distance from at least a part of the first distal edge to the first rotational axis is smaller than a radius of the maximum turning circle of said end surface of the first lobe.

10. The element according to claim 1, wherein, viewed in the direction parallel to the first rotational axis and the second rotational axis, a distance from at least a part of the second distal edge to the second rotational axis is smaller than a radius of the maximum turning circle of said end surface of the second lobe.

11. The element according to claim 1, wherein, viewed in the direction parallel to the first rotational axis and the second rotational axis, in the third angle of rotation, a radius of the first proximal edge relative to the first rotational axis is equal to or smaller than a radius of a base of the first lobe relative to the first rotational axis.

12. The element according to claim 1, wherein, viewed in the direction parallel to the first rotational axis and the second rotational axis, in the fourth angle of rotation, a radius of the second proximal edge relative to the second rotational axis is equal to or smaller than a radius of a base of the second lobe-relative to the second rotational axis.

13. The element according to claim 1, wherein, viewed in the direction parallel to the first rotational axis and the second rotational axis, outside the third angle of rotation, a distance from at least part the first proximal edge to the first rotational axis is greater than a radius of a base of the first lobe.

14. The element according to claim 1, wherein, viewed in the direction parallel to the first rotational axis and the second rotational axis, outside the fourth angle of rotation, a distance from at least part of the second proximal edge to the second rotational axis is greater than a radius of a base of the second lobe.

15. Device for compressing a gas, wherein the device comprises an element according to claim 1.

16. A method for evacuating compressed gas from an element according to claim 1, wherein the method comprises the step of evacuating the compressed gas from the internal space through the outlet opening, wherein no point of contact between said end surface of the first lobe and said end surface of the second lobe, viewed in the direction parallel to the first rotational axis and the second rotational axis, overlaps with the tongue-shaped protrusion at any time during the rotation cycle.

* * * * *